US010317129B2

(12) United States Patent
Curdt et al.

(10) Patent No.: US 10,317,129 B2
(45) Date of Patent: Jun. 11, 2019

(54) REFRIGERATOR SHELF WITH OVERFLOW PROTECTION SYSTEM INCLUDING HYDROPHOBIC LAYER

(71) Applicant: Schott AG, Mainz (DE)

(72) Inventors: Axel Curdt, Schlangenbad (DE); Oliver Gros, Rheinboellen (DE)

(73) Assignee: SCHOTT AG, Mainz (DE)

( * ) Notice: Subject to any disclaimer, the term of this patent is extended or adjusted under 35 U.S.C. 154(b) by 147 days.

(21) Appl. No.: 13/661,615

(22) Filed: Oct. 26, 2012

(65) Prior Publication Data

US 2014/0138337 A1 May 22, 2014

Related U.S. Application Data

(60) Provisional application No. 61/570,509, filed on Dec. 14, 2011.

(30) Foreign Application Priority Data

Oct. 28, 2011 (DE) ..... 10 2011 085 428

(51) Int. Cl.

| | |
|---|---|
| ***A47B 96/02*** | (2006.01) |
| ***A47B 96/06*** | (2006.01) |
| ***F25B 25/02*** | (2006.01) |
| ***F25D 25/02*** | (2006.01) |
| ***F24C 15/16*** | (2006.01) |
| *F24C 15/00* | (2006.01) |
| *F24C 15/10* | (2006.01) |

(52) U.S. Cl.

CPC ..... *F25D 25/02* (2013.01); *F24C 15/16* (2013.01); *F24C 15/005* (2013.01); *F24C 15/10* (2013.01); *F25D 2325/022* (2013.01)

(58) Field of Classification Search

CPC ... A47B 96/027; A47B 96/028; A47B 96/062; F25D 2325/022; F25D 25/02

USPC ..... 211/90.01, 90.02, 153; 248/250; 312/408

See application file for complete search history.

(56) References Cited

U.S. PATENT DOCUMENTS

| | | | |
|---|---|---|---|
| 392,061 | A | 10/1888 | Peckham |
| 870,439 | A | 11/1907 | Kade |

(Continued)

FOREIGN PATENT DOCUMENTS

| | | |
|---|---|---|
| CN | 1566891 | 1/2005 |
| CN | 101046271 | 10/2007 |

(Continued)

OTHER PUBLICATIONS

Handique, et al. "Microfluidic Flow Control Using Selective Hydrophobic Patterning", University of Michigan, Ann Arbor. Michigan, SPIE vol. 3224, 1997 pp. 185-195.

(Continued)

*Primary Examiner* — Joshua E Rodden

(74) *Attorney, Agent, or Firm* — Ohlandt, Greeley, Ruggiero & Perle, L.L.P.

(57) ABSTRACT

A refrigerator shelf is provided that includes a carrier plate and overflow protection. The carrier plate has a top side with a middle region for standing containers, with the overflow protection arranged around the middle region. The overflow protection includes, in a first portion, a hydrophobic layer on the carrier plate and, in a second portion which adjoins the first portion, a frame element.

44 Claims, 5 Drawing Sheets

(56) References Cited

U.S. PATENT DOCUMENTS 2,191,701 A 2/1940 Wood
D142,904 S * 11/1945 Paddock ..... D15/89
2,976,386 A 3/1961 Salton
3,185,426 A 5/1965 Bjerke
3,354,022 A 11/1967 Dettre
3,579,540 A 5/1971 Ohlhausen
3,716,502 A 2/1973 Loew
3,931,428 A 1/1976 Reick
3,963,349 A 6/1976 Albright
3,967,030 A 6/1976 Johnson
3,975,197 A 8/1976 Mikelsons
3,976,572 A 8/1976 Reick
3,980,153 A 9/1976 Andrews
4,142,724 A 3/1979 Reick
4,151,327 A 4/1979 Lawton
4,184,936 A 1/1980 Paul
4,199,142 A 4/1980 Reick
4,301,197 A 11/1981 Franz
4,301,213 A 11/1981 Davies
4,311,755 A 1/1982 Rummel
4,415,405 A 11/1983 Ruddle
4,451,619 A 5/1984 Heilmann
4,453,533 A 6/1984 Scheidler et al.
4,492,217 A 1/1985 Scheidler
4,581,149 A 4/1986 Horodysky
4,591,530 A 5/1986 Lui
4,614,464 A 9/1986 Christensen
4,624,900 A 11/1986 Fau
4,646,948 A 3/1987 Jennings
4,680,173 A 7/1987 Burger
4,687,707 A 8/1987 Matsuo
4,717,810 A 1/1988 Schreder
4,733,843 A 3/1988 Bessinger
4,738,426 A 4/1988 Bessinger
D295,950 S 5/1988 Johnston
4,749,110 A 6/1988 Maeno
4,753,977 A 6/1988 Merrill
4,782,112 A 11/1988 Kondo
4,835,014 A 5/1989 Roth
4,855,176 A 8/1989 Ohwaki et al.
4,870,907 A 10/1989 McKee
4,923,260 A * 5/1990 Poulsen ..... 312/408
4,934,541 A 6/1990 Bussan et al.
4,971,912 A 11/1990 Buhl
4,983,459 A 1/1991 Franz
4,997,684 A 3/1991 Franz et al.
5,004,302 A 4/1991 Stocking et al.
5,009,652 A 4/1991 Morgan
5,011,727 A 4/1991 Kido
5,011,963 A 4/1991 Ogawa
5,032,641 A 7/1991 Nanishi
5,041,304 A 8/1991 Kusano
5,057,050 A 10/1991 Hill
5,069,408 A 12/1991 Bessinger
5,084,191 A 1/1992 Nagase
5,121,134 A 6/1992 Albinson
5,156,611 A 10/1992 Haynes
5,202,361 A 4/1993 Zimmerman
5,225,274 A 7/1993 Ogawa et al.
5,228,764 A 7/1993 Cherry et al.
5,228,905 A 7/1993 Grunewalder
5,238,746 A 8/1993 Soga
5,240,774 A 8/1993 Ogawa
5,273,354 A 12/1993 Herrmann
5,274,159 A 12/1993 Pellerite
5,284,707 A 2/1994 Ogawa
5,294,252 A 3/1994 Gun
5,300,239 A 4/1994 Ozaki
5,308,705 A 5/1994 Franz et al.
5,316,799 A 5/1994 Brunken
5,317,129 A 5/1994 Taplan
5,324,566 A 6/1994 Ogawa
5,328,768 A 7/1994 Goodwin
5,338,345 A 8/1994 Scarborough
5,348,547 A 9/1994 Payne
5,352,733 A 10/1994 Hart
5,358,773 A 10/1994 Fujii et al.
5,362,145 A 11/1994 Bird et al.
5,364,299 A 11/1994 Hill
5,366,810 A 11/1994 Merrifield
5,368,892 A 11/1994 Berquier
5,372,888 A 12/1994 Ogawa
5,380,585 A 1/1995 Ogawa
5,385,966 A 1/1995 Hermansen
5,395,657 A 3/1995 Strepparola
5,403,084 A 4/1995 Kane et al.
5,406,894 A * 4/1995 Herrmann ..... A47B 96/028 108/108
5,424,130 A 6/1995 Nakanishi
5,429,433 A 7/1995 Bird et al.
5,435,839 A 7/1995 Ogawa
5,437,894 A 8/1995 Ogawa
5,437,900 A 8/1995 Kuzowski
5,441,338 A 8/1995 Kane
5,454,638 A 10/1995 Bird et al.
5,458,976 A 10/1995 Horino
5,464,492 A 11/1995 Gregory
5,466,770 A 11/1995 Audenaert
5,489,328 A 2/1996 Ono
5,500,216 A 3/1996 Julian
5,516,204 A 5/1996 Calvert et al.
5,523,161 A 6/1996 Goodwin
5,540,493 A 7/1996 Kane
5,556,667 A 9/1996 Teranishi et al.
5,558,940 A 9/1996 Michels
5,564,809 A 10/1996 Kane
5,576,096 A 11/1996 Ono
5,577,817 A 11/1996 Reynolds
5,578,361 A 11/1996 Tsujioka
5,584,957 A 12/1996 Schultheis et al.
5,585,896 A 12/1996 Yamazaki
5,590,861 A 1/1997 Ardolino
5,599,893 A 2/1997 Asai
5,612,433 A 3/1997 Ono
5,618,627 A 4/1997 Merrifield
5,651,921 A 7/1997 Kaijou
5,660,777 A 8/1997 Herrmann et al.
5,674,967 A 10/1997 Goodwin
5,679,460 A 10/1997 Schakenraad
5,688,864 A 11/1997 Goodwin
5,697,991 A 12/1997 Frazer
5,705,113 A 1/1998 Kane et al.
5,707,740 A 1/1998 Goodwin
5,725,789 A 3/1998 Huber
5,735,589 A 4/1998 Herrmann et al.
5,738,880 A 4/1998 Kane et al.
5,747,561 A 5/1998 Smirnov
5,753,734 A 5/1998 Maruyama
5,798,144 A 8/1998 Varanasi
5,800,785 A 9/1998 Bochner
5,800,918 A 9/1998 Chartier
5,813,741 A 9/1998 Fish
5,814,411 A 9/1998 Merrifield
5,824,421 A 10/1998 Kobayashi
5,830,259 A 11/1998 Kim et al.
5,830,529 A 11/1998 Ross
5,840,201 A 11/1998 Elledge
5,843,338 A 12/1998 Inoue
5,853,690 A 12/1998 Hibino
5,853,800 A 12/1998 Dombrowski
5,853,894 A 12/1998 Brown
5,856,378 A 1/1999 Ring
5,858,551 A 1/1999 Salsman
5,876,806 A 3/1999 Ogawa
5,890,907 A 4/1999 Minasian
5,910,557 A 6/1999 Audenaert
5,921,411 A 7/1999 Merl
5,924,359 A 7/1999 Watanabe
5,945,482 A 8/1999 Fukuchi
5,947,574 A 9/1999 Avendano
5,948,685 A 9/1999 Angros
5,952,053 A 9/1999 Colby
5,958,601 A 9/1999 Salsman
5,980,990 A 11/1999 Goodwin

(56) References Cited

U.S. PATENT DOCUMENTS 5,989,757 A 11/1999 Satoi
6,013,724 A 1/2000 Mizutani
6,017,609 A 1/2000 Akamatsu
6,017,831 A 1/2000 Beardsley
6,017,997 A 1/2000 Snow
6,024,948 A 2/2000 Samain
6,025,025 A 2/2000 Bartrug
6,033,738 A 3/2000 Teranishi
6,045,650 A 4/2000 Mitchnick
6,068,911 A 5/2000 Shouji
6,082,242 A 7/2000 Suzuki
6,090,447 A 7/2000 Suzuki
6,093,559 A 7/2000 Bookbinder
6,096,380 A 8/2000 Takebe
6,105,233 A * 8/2000 Neal ..... F25D 25/02 29/451
6,114,446 A 9/2000 Narisawa
6,117,555 A 9/2000 Fujimori
6,119,626 A 9/2000 Miyazawa
6,120,720 A 9/2000 Meier et al.
6,136,210 A 10/2000 Biegelsen
6,153,304 A 11/2000 Smith
6,155,677 A 12/2000 Kitani
6,187,143 B1 2/2001 Juppo
6,191,122 B1 2/2001 Lux
6,196,141 B1 3/2001 Herron, III et al.
6,197,438 B1 3/2001 Faulkner
6,201,058 B1 3/2001 Mahr
6,207,236 B1 3/2001 Araki
6,221,434 B1 4/2001 Visca
6,224,974 B1 5/2001 Wuu
6,228,435 B1 5/2001 Yoshikawa
6,228,972 B1 5/2001 Hikita
6,235,383 B1 5/2001 Hong
6,235,833 B1 5/2001 Akamatsu
6,245,387 B1 6/2001 Hayden
6,264,751 B1 7/2001 Kamura
6,280,834 B1 8/2001 Veerasamy
6,291,054 B1 9/2001 Thomas
6,308,728 B1 10/2001 Frazier
6,333,074 B1 12/2001 Ogawa
6,337,133 B1 1/2002 Akamatsu
6,340,502 B1 1/2002 Azzopardi
6,342,268 B1 1/2002 Samain
6,352,758 B1 3/2002 Huang et al.
6,358,569 B1 3/2002 Badyal
6,361,868 B1 3/2002 Bier
6,371,034 B1 4/2002 Simpson
6,372,507 B1 4/2002 Angros
6,376,592 B1 4/2002 Shimada
6,379,751 B1 4/2002 Schafer
6,383,642 B1 5/2002 Le Bellac
6,403,397 B1 6/2002 Katz
6,422,673 B1 * 7/2002 Bienick ..... 312/408
6,423,372 B1 7/2002 Genzer
6,451,432 B1 9/2002 Azzopardi
6,458,420 B1 10/2002 Akamatsu
6,461,537 B1 10/2002 Turcotte
6,461,670 B2 10/2002 Akamatsu
6,462,115 B1 10/2002 Takahashi
6,471,761 B2 10/2002 Fan
6,476,095 B2 11/2002 Simendinger
6,479,612 B1 11/2002 Del Pesco
6,482,524 B1 11/2002 Yamamoto
6,488,347 B1 12/2002 Bienick
6,555,384 B1 4/2003 Angros
6,564,935 B1 5/2003 Yamamoto
6,579,620 B2 6/2003 Mizunno
6,582,825 B2 6/2003 Amarasekera
6,584,744 B1 7/2003 Schultheis
6,596,060 B1 7/2003 Michaud
6,604,800 B2 8/2003 Hamilton
6,610,363 B2 8/2003 Arora
6,613,860 B1 9/2003 Dams
6,623,863 B2 9/2003 Kamitani
6,641,654 B2 11/2003 Akamatsu
6,644,609 B1 11/2003 Scott
6,649,222 B1 11/2003 D'Agostino
6,652,640 B2 11/2003 Asai
6,660,339 B1 12/2003 Datta
6,660,363 B1 12/2003 Barthlott
6,660,686 B2 12/2003 Inagaki
6,679,573 B2 1/2004 Bienick
6,683,126 B2 1/2004 Keller
6,685,992 B1 2/2004 Ogawa
6,689,200 B2 2/2004 Scarborough
6,692,565 B2 2/2004 Johansen, Jr.
6,706,798 B2 3/2004 Kobayashi
6,713,304 B2 3/2004 Angros
6,720,371 B2 4/2004 Furuta
6,729,704 B2 5/2004 Ames
6,743,467 B1 6/2004 Jones
6,767,984 B2 7/2004 Toui
6,770,323 B2 8/2004 Genzer
6,780,497 B1 8/2004 Walter
6,786,562 B2 * 9/2004 Obrock ..... C03B 23/033 211/153
6,793,821 B2 9/2004 Lee
6,800,354 B2 10/2004 Baumann et al.
6,806,299 B2 10/2004 Baumann
6,808,835 B2 10/2004 Green
6,811,045 B1 11/2004 Masker et al.
6,811,716 B1 11/2004 Stengaard
6,811,844 B2 11/2004 Trouilhet
6,818,451 B2 11/2004 Angros
6,845,788 B2 1/2005 Extrand
6,852,390 B2 2/2005 Extrand
6,855,375 B2 2/2005 Nakagawa
6,855,759 B2 2/2005 Kudo
6,858,284 B2 2/2005 Nun
6,871,923 B2 3/2005 Dietz
6,872,441 B2 3/2005 Baumann
6,890,360 B2 5/2005 Cole
6,923,216 B2 8/2005 Extrand
6,926,946 B2 8/2005 Ogawa
6,931,888 B2 8/2005 Shekunov
6,938,774 B2 9/2005 Extrand
6,942,746 B2 9/2005 Niejelow
6,966,990 B2 11/2005 Chattopadhyay
6,976,585 B2 12/2005 Extrand
6,976,998 B2 12/2005 Rizzo
6,994,045 B2 2/2006 Pazkowski
6,998,051 B2 2/2006 Chattopadhyay
7,019,069 B2 3/2006 Kobayashi
7,022,416 B2 4/2006 Teranishi
7,026,018 B2 4/2006 Kranivich
7,037,591 B2 5/2006 Henze
7,048,889 B2 5/2006 Arney
7,052,244 B2 5/2006 Fouillet
7,056,409 B2 6/2006 Dubrow
7,057,832 B2 6/2006 Wu
7,057,881 B2 6/2006 Chow
7,074,273 B2 7/2006 Shimomura
7,074,294 B2 7/2006 Dubrow
7,083,748 B2 8/2006 Chattopadhyay
7,083,828 B2 8/2006 Muller
7,108,833 B2 9/2006 Samsoondar
7,109,256 B2 9/2006 Amano
7,112,369 B2 9/2006 Wang
7,148,181 B2 12/2006 Tanaka
7,150,904 B2 12/2006 D'Urso
7,153,357 B2 12/2006 Baumgart
7,157,018 B2 1/2007 Scheidler
7,166,235 B2 1/2007 Majeti
7,175,723 B2 2/2007 Jones
7,179,758 B2 2/2007 Chakrapani
7,179,864 B2 2/2007 Wang
7,188,917 B2 3/2007 Bienick
7,198,855 B2 4/2007 Lienmann-Vinson
7,204,298 B2 4/2007 Hodes
7,211,223 B2 5/2007 Fouillet
7,211,313 B2 5/2007 Nun
7,211,329 B2 5/2007 Metz
7,211,605 B2 5/2007 Coronado

(56) References Cited

U.S. PATENT DOCUMENTS 7,213,309 B2 5/2007 Wang
D547,640 S 7/2007 Remmers
7,238,751 B2 7/2007 Wang
7,253,130 B2 8/2007 Chiang
7,258,731 B2 8/2007 D'Urso
7,264,845 B2 9/2007 Papadaki
7,265,468 B1 9/2007 Manel
7,273,658 B2 9/2007 Benayoun
7,285,331 B1 10/2007 Reihs
7,288,311 B2 10/2007 Kawashima
7,291,653 B2 11/2007 Baumann
7,306,304 B2 12/2007 Jang
7,306,895 B2 12/2007 Kano
7,309,278 B2 12/2007 Shibata
7,312,057 B2 12/2007 Bookbinder
7,323,033 B2 1/2008 Kroupenkine
7,338,835 B2 3/2008 Bao
7,342,551 B2 3/2008 King
7,344,619 B2 3/2008 Helmeke
7,344,758 B2 3/2008 Franchina
7,344,783 B2 3/2008 Shea
7,354,328 B2 4/2008 Lee
7,354,624 B2 4/2008 Millero
7,354,650 B2 4/2008 Nakajima
D568,344 S * 5/2008 Baacke ..... D15/89
7,368,510 B2 5/2008 Lee
7,388,211 B2 6/2008 Chao
7,393,515 B2 7/2008 Hoshino
7,396,395 B1 7/2008 Chen
7,419,615 B2 9/2008 Strauss
7,449,233 B2 11/2008 Arora
7,468,333 B2 12/2008 Kimbrell, Jr.
7,478,785 B2 1/2009 Herron, III
7,524,531 B2 4/2009 Axtell, III
7,527,832 B2 5/2009 Sakoske et al.
7,544,411 B2 6/2009 Baumann
D596,931 S 7/2009 Fernandez
D596,932 S 7/2009 Kleinsasser
7,563,505 B2 7/2009 Reihs
7,568,583 B2 8/2009 Wing
7,607,744 B2 10/2009 Casoli
D607,020 S 12/2009 Baacke
D612,404 S 3/2010 Picken
D612,405 S 3/2010 Eicher
D613,316 S 4/2010 Schmidt
7,726,615 B2 6/2010 Rutz
7,731,316 B2 6/2010 Wing
7,748,806 B2 7/2010 Egan
7,919,180 B2 4/2011 Furukawa
7,943,234 B2 5/2011 Lawin
7,989,619 B2 8/2011 Guire
8,071,219 B2 12/2011 Berrux
8,192,994 B2 6/2012 Angros
8,262,177 B2 9/2012 Picken et al.
8,286,561 B2 * 10/2012 Driver ..... A47B 95/043 108/108
8,287,062 B2 10/2012 Nash
8,372,496 B2 2/2013 Le Bris
8,596,205 B2 12/2013 Driver
9,179,773 B2 11/2015 Driver
9,207,012 B2 12/2015 Driver
2001/0018130 A1 8/2001 Hayden
2001/0019773 A1 9/2001 Akamatsu
2001/0024728 A1 9/2001 Kamitani
2001/0024805 A1 9/2001 Williams
2001/0030808 A1 10/2001 Komatsu
2001/0055677 A1 12/2001 Wuu
2002/0001676 A1 1/2002 Hayden
2002/0034627 A1 3/2002 Jacquiod
2002/0045007 A1 4/2002 Arora
2002/0077412 A1 6/2002 Kobayashi
2002/0111402 A1 8/2002 Mizuno
2002/0119595 A1 8/2002 Kim
2002/0149304 A1 10/2002 Bienick
2002/0177655 A1 11/2002 Pratt
2002/0192472 A1 12/2002 Metz
2002/0197490 A1 12/2002 Amidaiji
2003/0006683 A1 * 1/2003 Bienick ..... F25D 25/024 312/408
2003/0021902 A1 1/2003 Yamamoto
2003/0026972 A1 2/2003 Reihs
2003/0038571 A1 2/2003 Obrock et al.
2003/0040243 A1 2/2003 Ward
2003/0040568 A1 2/2003 Furuta
2003/0070677 A1 4/2003 Handique et al.
2003/0072723 A1 4/2003 Gers-Barlag
2003/0073067 A1 4/2003 Bookfinder
2003/0077533 A1 4/2003 Murota
2003/0091809 A1 5/2003 Scarborough
2003/0110976 A1 6/2003 Abidh
2003/0117051 A1 6/2003 Kweon
2003/0119684 A1 6/2003 Tsao
2003/0125656 A1 7/2003 Davankov
2003/0143339 A1 7/2003 Kobayashi
2003/0149218 A1 8/2003 Cote
2003/0166840 A1 9/2003 Urry
2003/0170401 A1 9/2003 Shimomura
2003/0176572 A1 9/2003 Maekawa
2003/0179494 A1 9/2003 Kaneko
2004/0005469 A1 1/2004 Metz et al.
2004/0025747 A1 2/2004 Kamitani
2004/0050297 A1 3/2004 Kobayashi
2004/0053058 A1 3/2004 Kamitani
2004/0056575 A1 3/2004 Dietz et al.
2004/0097616 A1 5/2004 Hoppler
2004/0102124 A1 5/2004 Suzuki
2004/0121168 A1 6/2004 Goodwin
2004/0137814 A1 7/2004 Kimbrell
2004/0138083 A1 7/2004 Kimbrell
2004/0154106 A1 8/2004 Oles
2004/0173549 A1 9/2004 Herron, III et al.
2004/0179973 A1 9/2004 Angros
2004/0201048 A1 10/2004 Seki
2004/0209072 A1 10/2004 Henze
2004/0209203 A1 10/2004 Kano
2004/0213904 A1 10/2004 Muller
2004/0216227 A1 11/2004 Papadaki
2004/0245146 A1 12/2004 Kulp
2005/0000463 A1 1/2005 Mochizuki
2005/0004264 A1 1/2005 Tanabe
2005/0008859 A1 1/2005 Forgacs
2005/0009953 A1 1/2005 Shea
2005/0022313 A1 2/2005 Scheidler
2005/0031489 A1 2/2005 Angros
2005/0053793 A1 3/2005 Benay-Oun
2005/0063876 A1 3/2005 Angros
2005/0070026 A1 3/2005 Angros
2005/0075020 A1 4/2005 Benayoun
2005/0106762 A1 5/2005 Chakrapani
2005/0121782 A1 6/2005 Nakamura et al.
2005/0143547 A1 6/2005 Stark
2005/0165194 A1 7/2005 Benayoun
2005/0170098 A1 8/2005 Baumann
2005/0221098 A1 10/2005 Azzopardi
2005/0239211 A1 10/2005 Uchihara
2005/0245395 A1 11/2005 Tanaka
2006/0013983 A1 1/2006 Sebastian
2006/0029808 A1 2/2006 Zhai et al.
2006/0040164 A1 2/2006 Vyas
2006/0051561 A1 3/2006 Badyal
2006/0052556 A1 3/2006 Franchina
2006/0057390 A1 3/2006 Kittle
2006/0062695 A1 3/2006 Haab
2006/0062929 A1 3/2006 Kittle
2006/0081394 A1 4/2006 Li
2006/0089466 A1 4/2006 Shimomura
2006/0110541 A1 5/2006 Russell
2006/0110542 A1 5/2006 Dietz
2006/0113443 A1 6/2006 Remmers
2006/0147634 A1 7/2006 Strauss
2006/0151739 A1 7/2006 Sandner
2006/0154048 A1 7/2006 Teranashi
2006/0162373 A1 7/2006 McMillin
2006/0172641 A1 8/2006 Hennige

(56) References Cited

U.S. PATENT DOCUMENTS

2006/0185555 A1 8/2006 Geissler
2006/0207032 A1 9/2006 Reiners
2006/0213849 A1 9/2006 Bienick
2006/0222865 A1 10/2006 Hoshino
2006/0263516 A1 11/2006 Jones
2006/0266258 A1 11/2006 Asakura
2006/0269758 A1 11/2006 Helmeke
2006/0281889 A1 12/2006 Kobayashi
2006/0286305 A1 12/2006 Thies
2006/0292345 A1 12/2006 Dave
2007/0003705 A1 1/2007 Strauss
2007/0005024 A1 1/2007 Weber
2007/0009657 A1 1/2007 Zhang
2007/0014970 A1 1/2007 Nun
2007/0026193 A1 2/2007 Luzinov
2007/0028625 A1 2/2007 Joshi
2007/0046160 A1 3/2007 Egan
2007/0065668 A1 3/2007 Idei
2007/0075199 A1 4/2007 Stewart
2007/0141114 A1 6/2007 Muisener
2007/0141306 A1 6/2007 Kasai
2007/0148407 A1 6/2007 Chen
2007/0166513 A1 7/2007 Sheng
2007/0172650 A1 7/2007 O'Rear
2007/0172658 A1 7/2007 Deruelle
2007/0172661 A1 7/2007 Fechner
2007/0176379 A1 8/2007 Sonnendorfer
2007/0196656 A1 8/2007 Rowell
2007/0202342 A1 8/2007 Whiteford
2007/0213230 A1 9/2007 Pfeiffer
2007/0215004 A1 9/2007 Kuroda
2007/0218265 A1 9/2007 Harris
2007/0224898 A1 9/2007 Deangelis
2007/0231517 A1 10/2007 Golownia
2007/0238807 A1 10/2007 Safir
2007/0259156 A1 11/2007 Kempers
2007/0274871 A1 11/2007 Jiang
2007/0275245 A1 11/2007 Persson
2007/0298216 A1 12/2007 Jing
2008/0012459 A1 1/2008 Picken
2008/0018709 A1 1/2008 Takenaka
2008/0020127 A1 1/2008 Whiteford
2008/0021212 A1 1/2008 Whiteford
2008/0032403 A1 2/2008 Saito
2008/0039558 A1 2/2008 Lazzari
2008/0044635 A1 2/2008 O'Neill
2008/0050567 A1 2/2008 Kawashima
2008/0063870 A1 3/2008 O'Rear
2008/0066648 A1 3/2008 Asakura
2008/0070146 A1 3/2008 Fomitchev
2008/0088192 A1 4/2008 Hsu
2008/0090004 A1 4/2008 Zhang
2008/0101041 A1 5/2008 Chang
2008/0102347 A1 5/2008 Blunk
2008/0107864 A1 5/2008 Zhang
2008/0131653 A1 6/2008 Lyons
2008/0133276 A1 6/2008 Abe et al.
2008/0160257 A1 7/2008 Takada
2008/0166549 A1 7/2008 Shieh
2008/0171805 A1 7/2008 Mingarelli
2008/0172937 A1 7/2008 Palmer
2008/0176991 A1 7/2008 Osawa
2008/0197760 A1 8/2008 Leconte
2008/0199657 A1 8/2008 Capron
2008/0199659 A1 8/2008 Zhao
2008/0205950 A1 8/2008 Moorlag
2008/0206550 A1 8/2008 Borlner
2008/0207581 A1 8/2008 Whiteford
2008/0213601 A1 9/2008 Yamamoto
2008/0220170 A1 9/2008 Van Der Flaas
2008/0220676 A1 9/2008 Marin
2008/0221009 A1 9/2008 Kanagasabapathy et al.
2008/0221263 A1 9/2008 Kanagasabapathy
2008/0226694 A1 9/2008 Gelbart
2008/0233355 A1 9/2008 Henze
2008/0237126 A1 10/2008 Hoek
2008/0241512 A1 10/2008 Boris
2008/0241523 A1 10/2008 Huignard
2008/0245273 A1 10/2008 Vyorkka
2008/0246804 A1 10/2008 Kawase
2008/0248263 A1 10/2008 Kobrin
2008/0250978 A1 10/2008 Baumgart
2008/0261024 A1 10/2008 Xenopoulos
2008/0268233 A1 10/2008 Lawin
2008/0269358 A1 10/2008 Inoue
2008/0280699 A1 11/2008 Jarvholm
2008/0286556 A1 11/2008 D'Urso
2008/0295347 A1 12/2008 Braham
2008/0296252 A1 12/2008 D'Urso
2008/0306202 A1 12/2008 Lin
2008/0310660 A1 12/2008 Lin
2008/0316587 A1 12/2008 Tijburg
2009/0010870 A1 1/2009 Greiner
2009/0011222 A1 1/2009 Xiu
2009/0011227 A1 1/2009 Furukawa
2009/0011960 A1 1/2009 Wu
2009/0018249 A1 1/2009 Kanagasabapathy et al.
2009/0025508 A1 1/2009 Liao
2009/0025609 A1 1/2009 Egami
2009/0032088 A1 2/2009 Rabinowitz
2009/0036978 A1 2/2009 Kleiner
2009/0042469 A1 2/2009 Simpson
2009/0058247 A1 3/2009 Collins
2009/0064894 A1 3/2009 Baumgart
2009/0076430 A1 3/2009 Simpson
2009/0084914 A1 4/2009 Picken
2009/0085453 A1 4/2009 Daley
2009/0087670 A1 4/2009 Peng
2009/0095941 A1 4/2009 Nakata
2009/0099301 A1 4/2009 Naraghi
2009/0105409 A1 4/2009 Munzmay
2009/0105679 A1 4/2009 Joubert
2009/0111344 A1 4/2009 Murphy
2009/0134758 A1 5/2009 Vardon
2009/0136737 A1 5/2009 Ring
2009/0142604 A1 6/2009 Imai
2009/0155566 A1 6/2009 Gentleman
2009/0162592 A1 6/2009 Baikerikar
2009/0163637 A1 6/2009 Li
2009/0182085 A1 7/2009 Escobar Barrios
2009/0186070 A1 7/2009 Guire
2009/0188877 A1 7/2009 Stewart
2009/0195136 A1 8/2009 Wing
2009/0212505 A1 8/2009 McMillin
2009/0216540 A1 8/2009 Tessel et al.
2009/0226648 A1 9/2009 Wild et al.
2009/0298369 A1 12/2009 Koene
2010/0001625 A1 1/2010 Eckartsberg
2010/0003493 A1 1/2010 Cheng
2010/0026156 A1 2/2010 Leconte
2010/0052491 A1 3/2010 Vardon
2010/0102693 A1* 4/2010 Driver et al. ..... 312/408
2010/0109498 A1 5/2010 Ramm
2010/0117502 A1 5/2010 Kang
2010/0133970 A1 6/2010 Shin
2010/0176703 A1 7/2010 Kim
2010/0181884 A1 7/2010 De La Garza
2010/0196702 A9 8/2010 Furukawa
2010/0213334 A1 8/2010 Davenport
2010/0294721 A1 11/2010 Frazier
2010/0330347 A1 12/2010 Badyal
2011/0164399 A1 7/2011 Driver
2011/0198976 A1* 8/2011 Bradley et al. ..... 312/408
2011/0268973 A1 11/2011 Guire
2012/0009396 A1 1/2012 Sikka et al.
2012/0045954 A1 2/2012 Bleecher et al.
2012/0104924 A1* 5/2012 Nash ..... F25D 25/02 312/408
2012/0104925 A1 5/2012 Nash
2012/0216880 A1 8/2012 Nall
2012/0234113 A1 9/2012 Angros
2013/0037505 A1 2/2013 Driver
2014/0138337 A1 5/2014 Curdt
2016/0037923 A1 2/2016 Driver

(56) References Cited

U.S. PATENT DOCUMENTS

FOREIGN PATENT DOCUMENTS

| | | | |
|---|---|---|---|
| CN | 101331411 | | 12/2008 |
| DE | 10018671 | | 10/2001 |
| EP | 0207282 | | 1/1987 |
| EP | 0307915 | | 3/1989 |
| EP | 0317057 | | 5/1989 |
| EP | 0332141 | | 9/1989 |
| EP | 0399568 | | 11/1990 |
| EP | 0452723 | | 10/1991 |
| EP | 0472215 | | 2/1992 |
| EP | 0493270 | | 7/1992 |
| EP | 0527658 | A1 | 2/1993 |
| EP | 0545201 | | 6/1993 |
| EP | 0623656 | | 11/1994 |
| EP | 0649887 | | 4/1995 |
| EP | 0657393 | | 6/1995 |
| EP | 0657939 | | 6/1995 |
| EP | 0714870 | | 6/1996 |
| EP | 0714921 | | 6/1996 |
| EP | 0719743 | | 7/1996 |
| EP | 0719821 | | 7/1996 |
| EP | 0739714 | | 10/1996 |
| EP | 0745567 | | 12/1996 |
| EP | 0745568 | | 12/1996 |
| EP | 0752459 | | 1/1997 |
| EP | 0770706 | | 5/1997 |
| EP | 0799791 | | 10/1997 |
| EP | 0811430 | | 12/1997 |
| EP | 0856712 | A2 | 8/1998 |
| EP | 0859207 | | 8/1998 |
| EP | 0863191 | | 9/1998 |
| EP | 0903389 | | 3/1999 |
| EP | 0913369 | A1 | 5/1999 |
| EP | 0914873 | | 5/1999 |
| EP | 0915103 | | 5/1999 |
| EP | 0930351 | | 7/1999 |
| EP | 1048696 | | 11/2000 |
| EP | 1097979 | | 5/2001 |
| EP | 1108735 | | 6/2001 |
| EP | 1113064 | | 7/2001 |
| EP | 1136539 | | 9/2001 |
| EP | 1180533 | | 2/2002 |
| EP | 1193289 | | 4/2002 |
| EP | 1215252 | | 6/2002 |
| EP | 1047735 | | 4/2003 |
| EP | 1362904 | | 11/2003 |
| EP | 1187872 | | 1/2004 |
| EP | 1387011 | | 2/2004 |
| EP | 1387169 | | 2/2004 |
| EP | 1407792 | | 4/2004 |
| EP | 1261559 | | 6/2004 |
| EP | 1433821 | | 6/2004 |
| EP | 0969718 | | 9/2004 |
| EP | 1473355 | | 11/2004 |
| EP | 1475234 | | 11/2004 |
| EP | 1479738 | | 11/2004 |
| EP | 1524290 | | 4/2005 |
| EP | 1360253 | | 7/2005 |
| EP | 1492837 | | 7/2005 |
| EP | 1392619 | | 8/2005 |
| EP | 1583615 | | 11/2006 |
| EP | 1752284 | | 2/2007 |
| EP | 1503813 | | 5/2007 |
| EP | 1392772 | | 7/2007 |
| EP | 1857497 | | 11/2007 |
| EP | 1873218 | | 1/2008 |
| EP | 1429919 | | 4/2008 |
| EP | 1908804 | | 4/2008 |
| EP | 1875279 | | 7/2008 |
| EP | 1401903 | | 8/2008 |
| EP | 1883669 | | 9/2008 |
| EP | 1988129 | | 11/2008 |
| EP | 1997619 | | 12/2008 |
| EP | 0904343 | | 7/2009 |
| EP | 2318793 | A1 | 5/2011 |
| GB | 1341605 | | 12/1973 |
| JP | S62246960 | | 10/1987 |
| JP | H1113355 | A | 1/1999 |
| JP | 2004308984 | A | 11/2004 |
| JP | 2007182491 | | 7/2007 |
| JP | 2008228958 | A | 10/2008 |
| JP | 2009071672 | | 4/2009 |
| KR | 20030052853 | | 6/2003 |
| MX | 175646 | | 8/1994 |
| MX | 183533 | | 12/1996 |
| MX | 192053 | | 5/1999 |
| MX | 195031 | | 1/2000 |
| MX | 199899 | | 11/2000 |
| MX | 201072 | | 3/2001 |
| MX | 203880 | | 8/2001 |
| MX | 205074 | | 11/2001 |
| MX | PA01011653 | | 12/2002 |
| MX | 215752 | | 8/2003 |
| MX | PA02006399 | | 9/2003 |
| MX | PA04010165 | | 2/2005 |
| MX | PA05006898 | | 8/2005 |
| MX | PA02012841 | | 1/2006 |
| MX | 234477 | | 2/2006 |
| MX | PA06003323 | | 12/2006 |
| WO | 9104305 | | 4/1991 |
| WO | 9316131 | | 8/1993 |
| WO | 9413734 | | 6/1994 |
| WO | 9604123 | | 2/1996 |
| WO | 9607621 | | 3/1996 |
| WO | 9707993 | | 3/1997 |
| WO | 9820960 | | 5/1998 |
| WO | 9923137 | | 5/1999 |
| WO | 9923437 | | 5/1999 |
| WO | 9940431 | | 8/1999 |
| WO | 9947578 | | 9/1999 |
| WO | 9948339 | | 9/1999 |
| WO | 9957185 | | 11/1999 |
| WO | 9964363 | | 12/1999 |
| WO | 0005321 | | 2/2000 |
| WO | 0014297 | | 3/2000 |
| WO | 0025938 | | 5/2000 |
| WO | 0034361 | | 6/2000 |
| WO | 0039240 | | 7/2000 |
| WO | 0046464 | | 8/2000 |
| WO | 0066241 | | 11/2000 |
| WO | 0119745 | | 3/2001 |
| WO | 0162682 | | 8/2001 |
| WO | 0174739 | | 10/2001 |
| WO | 0179142 | | 10/2001 |
| WO | 0179371 | | 10/2001 |
| WO | 0198399 | | 12/2001 |
| WO | 0214417 | | 2/2002 |
| WO | 0220259 | A1 | 3/2002 |
| WO | 0228951 | | 4/2002 |
| WO | 02062910 | | 8/2002 |
| WO | 02074869 | | 9/2002 |
| WO | 02098983 | | 12/2002 |
| WO | 03010255 | | 2/2003 |
| WO | 03012004 | | 2/2003 |
| WO | 03030879 | | 4/2003 |
| WO | 03037702 | | 5/2003 |
| WO | 03045693 | | 6/2003 |
| WO | 03080258 | | 10/2003 |
| WO | 03093568 | | 11/2003 |
| WO | 2004012625 | | 2/2004 |
| WO | 2004043319 | | 5/2004 |
| WO | 2004058418 | | 7/2004 |
| WO | 2004072556 | | 8/2004 |
| WO | 2004104116 | | 12/2004 |
| WO | 2004110132 | | 12/2004 |
| WO | 2005021843 | | 3/2005 |
| WO | 2005023935 | | 3/2005 |
| WO | 2005028562 | | 3/2005 |
| WO | 2005068399 | | 7/2005 |
| WO | 2005077429 | | 8/2005 |
| WO | 2006044641 | A2 | 4/2006 |
| WO | 2006044642 | | 4/2006 |
| WO | 2006081891 | | 8/2006 |

(56) References Cited

FOREIGN PATENT DOCUMENTS

| | | |
|---|---|---|
| WO | 2006083600 | 8/2006 |
| WO | 2006101934 | 9/2006 |
| WO | 2006135755 | 12/2006 |
| WO | 2007011731 | 1/2007 |
| WO | 2007027276 | 3/2007 |
| WO | 2007052260 | 5/2007 |
| WO | 2007053266 | 5/2007 |
| WO | 2007056427 | 5/2007 |
| WO | 2007070801 | 6/2007 |
| WO | 2007075407 | 7/2007 |
| WO | 2007092746 | 8/2007 |
| WO | 2007102960 | 9/2007 |
| WO | 2007104494 | 9/2007 |
| WO | 2007126432 | 11/2007 |
| WO | 2007126743 | 11/2007 |
| WO | 2007130294 | 11/2007 |
| WO | 2007149617 | 12/2007 |
| WO | 2008004827 | 1/2008 |
| WO | 2008004828 | 1/2008 |
| WO | 2008006078 | 1/2008 |
| WO | 2008021791 | 2/2008 |
| WO | 2008035347 | 3/2008 |
| WO | 2008035917 | 3/2008 |
| WO | 2008050895 | 5/2008 |
| WO | 2008051221 | 5/2008 |
| WO | 2008066828 | 6/2008 |
| WO | 2008078346 | 7/2008 |
| WO | 2008106494 | 9/2008 |
| WO | 2008112158 | 9/2008 |
| WO | 2008123650 | 10/2008 |
| WO | 2008123955 | 10/2008 |
| WO | 2008123961 | 10/2008 |
| WO | 2008134243 | 11/2008 |
| WO | 2008137973 | 11/2008 |
| WO | 2008151991 | 12/2008 |
| WO | 2008153687 | 12/2008 |
| WO | 2009003847 | 1/2009 |
| WO | 2009005465 | 1/2009 |
| WO | 2009012116 | 1/2009 |
| WO | 2009018327 | 2/2009 |
| WO | 2009037717 | 3/2009 |
| WO | 2009041752 | 4/2009 |
| WO | 2009061199 | 5/2009 |
| WO | 2009148611 | 12/2009 |
| WO | 2009158567 A1 | 12/2009 |
| WO | 2010042191 | 4/2010 |
| WO | 2010042668 A1 | 4/2010 |
| WO | 2012115986 | 8/2012 |

OTHER PUBLICATIONS

Picken, Alan D., U.S. Appl. No. 60/619,087, dated Oct. 15, 2004, 28 pages.

Picken, Alan D., U.S. Appl. No. 60/707,623, dated Aug. 12, 2005, 39 pages.

2009 R&D Award Entry Form (p. 5 excerpt from another document) showing Fig. 1 Schematic of NICE ("no ice nanocoating") (2009).

Bayer Materials Science product information on Bayhydrol 110 polyurethane dispersion (two first pages of this brochure) (Aug. 2002), 3 pages.

Bayer Materials Science product information on Bayhydrol 122 polyurethane dispersion (Jan. 2004), 3 pages.

Bayer Materials Science product information on Bayhydrol 124 polyurethane dispersion (Jan. 2004), 4 pages.

Bayer Materials Science product information on Bayhydrol 140AQ polyurethane dispersion (Aug. 2002), 3 pages.

Bayer Materials Science product information on Bayhydrol A145, aqueous hydroxyl-functional polyurethane dispersion (Jan. 2010), 4 pages.

Clark et al., Paints and Pigments, downloaded from the Internet at: <http://nzic.org.nz/ChemProcesses/polymers/10D.pdf> (copyright Aug. 2005), 19 pages.

Kobayashi et al., Surface Tension of Poly[(3,3,4,4,5,5,6,6,6-nonafluorohexyl)-methylsiloxane], Marcomolecules, 23:4929-4933 (1990).

* cited by examiner

REFRIGERATOR SHELF WITH OVERFLOW PROTECTION SYSTEM INCLUDING HYDROPHOBIC LAYER

CROSS REFERENCE TO RELATED APPLICATIONS

This application claims the benefit of U.S. Provisional Application Ser. No. 61/570,509, filed Dec. 14, 2011 and claims the benefit under 35 U.S.C. § 119(a) of German Patent Application No. 10 2011 085 428.2, filed Oct. 28, 2011.

BACKGROUND OF THE INVENTION

1. Field of the Invention

The present invention relates to an shelf, in particular an shelf for a refrigerator.

2. Description of Related Art

Refrigerator shelves consist, as a rule, of a grid or of a glass pane which is provided with mechanical elements for holding in a refrigerator. Glass panes are distinguished not only by the advantage of better stability of the refrigerated stock, as compared with grids, but also, inter alia, in that liquids running out can be captured by the pane, so that contamination of the lower-lying region of the refrigerator can be avoided. Lateral overflow of liquids can in this case be avoided in various ways.

A customary solution for overflow protection consists of a plastic frame which surrounds the glass pane on all sides and which forms a margin around the pane. The disadvantage is that a plastic margin of this type is complicated to produce and reduces the standing surface which can be used for the refrigerated stock. Furthermore, the peripheral frame makes it difficult to clean the refrigerator shelf.

EP 0859207 proposes to provide a glass pane with arching so that an overflow volume of at least 100 $cm^3$ can be accommodated before overflow occurs. At the same time, a frame around the glass pane may be dispensed with. However, achieving the arching according to the invention entails an additional complicated process step in production.

The object of the invention is to provide an shelf for a refrigerator, having overflow protection, which is improved in relation to the prior art.

SUMMARY OF THE INVENTION

The following description of the invention assumes that the shelf according to the invention and the overflow protection are in an installed state, so that, as seen by a user, this has a top side, an underside and also front, rear and side edges.

The shelf according to the invention comprises a carrier plate and overflow protection, the top side of the carrier plate having a middle region for standing containers and the overflow protection being arranged around the middle region. The shelf is characterized in that the overflow protection is designed, in a first portion, in the form of a hydrophobic layer on the carrier plate and, in a second portion which adjoins the first portion, comprises a frame element.

The carrier plate is preferably a plane glass plate with a material thickness of 3 to 8 mm. It is preferably commercially available prestressed float glass, that is to say a soda-lime glass. However, the carrier plates may also consist likewise of glass ceramic, plastic or metal or combinations of the materials mentioned.

In the middle region of the carrier plate, the carrier plate preferably has no coating, although the middle region may also be coated. However, the coating should have no hydrophobic properties, since the effectiveness of the hydrophobic layer of the overflow protection is thereby reduced.

The first and the second portion may, in general, extend in each case only over a small fraction of the circumference of the carrier plate, for example part of one side of the carrier plate, or else over a large fraction of the circumference of the carrier plate, for example over several sides of the carrier plate.

The hydrophobic layer may be any hydrophobic layer system which has sufficient resistance to chemicals and sufficient mechanical strength. Suitable layer systems are known to a person skilled in the art.

A typical example of a hydrophobic layer system is the inorganic/organic hybrid polymers which are known under the trade mark ORMOCER® of the Fraunhofer Institute for Silicate Research. On the other hand, there is a multiplicity of hydrophobic organic solutions which can be applied after manufacture or else by the final customer, for example a group of solutions which have become known under the trade mark "Clear Shield®".

DE 100 18 671 A1 likewise discloses a suitable hydrophobic coating on glass or ceramic material, the said coating having an especially high mechanical strength. It comprises a thin underlayer composed of a metal compound, in particular of inorganic or organic compounds with preferably trivalent or tetravalent metals, such as Si, Al, Ti and Zr, and also an outer hydrophobic organic layer composed of siloxane, silane, fluorosilanepolyurethane or tetrafluoropolyethylene.

The hydrophobic layer exerts its action as overflow protection essentially on account of its special hydrophobicity, not because of its vertical extent. Depending on the intensity of hydrophobicity and on the strength of the liquid, a hydrophobic layer may, as a liquid barrier, have the effect of a mechanical barrier of a height of approximately 5 mm or more, although it may have a height of markedly less than 1 mm.

The hydrophobic layer may be of transparent or else coloured form.

A frame element is to be understood in general to mean a mechanical element which, essentially on account of its vertical extent, constitutes a barrier to liquid running out. It may be, for example, a plastic strip which is glued to the carrier plate or a profile strip which is plugged onto the side edge of the carrier plate and projects vertically above the surface of the carrier plate.

The overflow protection may comprise only the first and the second portion, but also further portions which, together with the first and the second portion, form the overflow protection. The overflow protection preferably surrounds the middle region of the carrier plate completely.

The hydrophobic layer is preferably arranged along the outer margin of the carrier plate in the form of a band with a width of 0.5 to 5 cm and in each case runs parallel to one of the outer edges of the carrier plate. It may, however, also be arranged at a distance from the outer edge.

The hydrophobic layer preferably has a layer thickness of 5 nm to 100 μm. There is therefore no or only a slight height difference with respect to the uncoated region of the carrier plate and therefore the surface having the hydrophobic layer can be utilized fully as a standing surface.

In a preferred embodiment, the hydrophobic layer is arranged in the form of an adhesive tape on the carrier plate, thus making it possible to apply the layer in an especially simple way.

Preferably no frame element or other element which projects vertically above the surface of the hydrophobic layer is arranged in the first portion, that is to say the hydrophobic layer alone acts as overflow protection.

In the second portion in which the overflow protection comprises a frame element, the frame element is preferably arranged along the outer edge of the carrier plate and is connected, liquid-tight, to the carrier plate. The frame element may in this case be arranged only on the top side of the carrier plate or else may extend, preferably in the form of a profile strip, around the outer edge of the carrier plate. The liquid-tight connection may in this case be designed, for example, in the form an unreleasable adhesive bond or else in the form of a sealing lip which makes it possible to release the frame element. This makes it possible, inter alia, to clean the frame element thoroughly in a simple way.

The frame element preferably projects vertically above the top side of the carrier plate by a height H of 1.0 mm or more. The frame element especially preferably projects above the top side of the carrier plate by 2.0 to 20.0 mm. The frame element can at the same time fulfil further functions in addition to its function as overflow protection. A frame element on the front side of the shelf may be designed as a grip part for pulling out the shelf, for example by means of a lip arranged on the underside. A frame element on the side of the shelf may be designed as a lateral guide rail which, together with a correspondingly designed guide in the refrigerator, forms a rest for the shelf. A frame element on the rear side may be designed as a rear shelf boundary which delimits the standing surface to the rear.

The frame element or part of the frame element may be designed to be removable, so that liquid captured by the overflow protection can be discharged in a controlled way. The removable part of the frame element may have, for example, a width of 0.5 cm to 5 cm and be contrasted in colour and/or shape from the frame element. The frame element may likewise extend over the entire front edge of the carrier plate and be designed to be removable. If liquid has run out and been captured by the overflow protection, it is generally difficult to remove the liquid from the shelf within the confined inner space of the refrigerator. It is also not readily possible to take out the shelf, since, even when the shelf is tilted only slightly, the liquid may overflow. In the proposed solution, a collecting container is arranged under the removable part of the frame element and the removable part is removed so that the liquid flows off into the container. The proposed solution thus makes it possible in a simple way to discharge at least some of the liquid which has run out, so that the removal of the liquid is, overall, conveniently possible. In this preferred embodiment, the carrier plate may have a slight inclination of 1° to 8°, preferably 2° to 5°, with respect to the horizontal, the removable part of the frame element lying at the lowest point, so that a large part of the liquid can be discharged in a controlled way. The inclination in this case relates to an installed state of the shelf, with the refrigerator oriented horizontally.

In a second portion, too, in which the overflow protection comprises a frame element, a hydrophobic layer may additionally be arranged between the frame element and the middle region, so that the frame element is protected from impurities.

The overflow protection has, as seen by a user, a front-side portion, a rear-side portion and two lateral portions, the front-side portion being located on the side facing the user and the rear-side portion being located on the side facing away from the user.

In a preferred embodiment, the lateral portions of the overflow protection are designed, essentially over their entire length, as a hydrophobic layer, and the front-side and/or rear-side portion comprise/comprises, essentially over the entire length, a frame element. Essentially is to be understood in this context to mean a length fraction of at least 50%, but preferably 80% or more, preferably only the transition regions arranged in the corners being accepted. This shelf has an especially wide standing surface. It has, furthermore, the advantage that, in the region of the especially stressed front edge of the shelf, the frame element at the same time protects the front edge of the carrier plate from shocks, for example when the refrigerator is being loaded with bottles. Moreover, no wear of the frame profile occurs during frequent loading and unloading. By contrast, when there is a hydrophobic coating in the region of the front edge, there is the risk that this becomes worn as a result of frequent loading and unloading and its effectiveness diminishes.

The hydrophobic layer is therefore preferably arranged only in the surface regions of the shelf which are at less risk of abrasion.

In a further preferred embodiment, the lateral portions of the overflow protection comprise, essentially over their entire length, a frame element, and the front-side and/or rear-side portion are/is designed, essentially over their entire length, as a hydrophobic layer. Essentially is to be understood in this context to mean a length fraction of at least 50%, but preferably 80% or more, preferably only the transition regions arranged in the corners being accepted. The shelf consequently affords an especially deep standing surface. In this embodiment, the lateral frame elements preferably serve at the same time for guiding and holding the shelf, so that further carrying elements, such as, for example, angle pieces arranged under the shelf, may be dispensed with.

In a first embodiment, in a transition region between a first portion, in which the overflow protection is designed in the form of a hydrophobic layer on the carrier plate, and a second portion, which adjoins the first portion and in which the overflow protection comprises a frame element, the hydrophobic layer runs as far as the lower edge of the frame element or underneath the frame element. In the first instance, therefore, the hydrophobic layer directly adjoins the frame element and is delimited by this. Consequently, in the case of a minimal extent of the transition region, the first and the second portion adjoin one another. In the latter instance, the hydrophobic layer extends from the first portion beneath the frame element in the transition region, that is to say is arranged in the transition region between the carrier plate and frame element. Exact delimitation of the hydrophobic layer signifying a higher outlay in manufacturing terms can thereby advantageously be dispensed with.

In a further embodiment of the transition region between a first portion and a second portion, the hydrophobic layer runs from the first portion as far as the lower edge of the frame element and is then continued in the transition region on the rising edge of the frame element. This embodiment ensures that a transition region does not constitute in the overflow protection a weak point where liquid preferentially runs out.

Particularly in this embodiment of the transition region, the hydrophobic layer may be arranged on an adhesive tape which can be glued to the carrier plate and to the frame element.

The invention relates, furthermore, to a carrier plate according to the same inventive principle.

The carrier plate according to the invention has overflow protection which is arranged along the circumference of the carrier plate, the overflow protection being designed, in a first portion, in the form of a hydrophobic layer on the carrier plate and, in a second portion which adjoins the first portion, comprising a frame element. The carrier plate may be designed, for example, as a worktop, table top, cutting board, cooking hob, cooking pocket, oven lid or shop counter or a component of these. It may be, in particular, a cooking hob made from glass or glass ceramic.

BRIEF DESCRIPTION OF THE DRAWINGS

The invention, then, is explained in more detail by means of FIGS. 1 to 4.

Figure 3D shows a perspective illustration of further preferred embodiments.

DETAILED DESCRIPTION OF THE INVENTION

The following figure description assumes that the refrigerator shelf according to the invention is in an installed state, so that, as seen by the user of the refrigerator, it has a top side, an underside and also front, rear and side edges.

Figure 1:
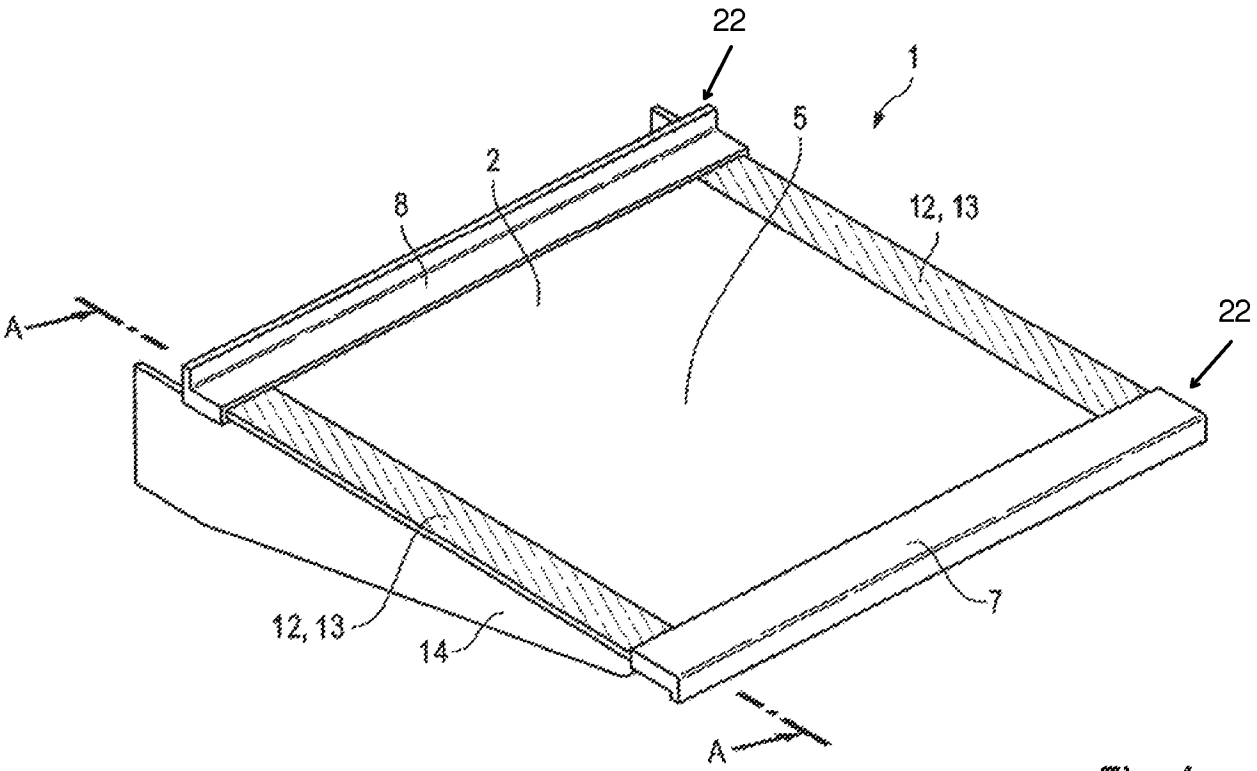
FIG. 1 shows a perspective illustration of a first preferred embodiment.

FIG. 1 shows a shelf (1) for a refrigerator according to a first preferred embodiment of the invention. In this embodiment, a frame element (22) is formed at the front edge and forms the front-side portion (7) of the overflow protection, and a frame element (22) is formed at the rear edge of the carrier plate and forms the rear-side portion (8) of the overflow protection, the said frame element extending respectively over the full length of the front edge and the rear edge. A band (13) of a hydrophobic layer (12) extends along each of the two sides of the carrier plate (2). The frame element (22), which constitutes the front-side portion (7) of the overflow protection, is designed in the form of a profile strip which is plugged onto the front edge of the carrier plate (2). This profile strip is designed at the same time as a grip element as a result of a lip on the underside of the frame profile, in order to make it possible to pull out the shelf (1). The frame element (22) which constitutes the rear-side portion (8) of the overflow protection is likewise designed in the form of a profile strip which is plugged onto the rear edge. The useful standing surface of the carrier plate (2) is consequently delimited mechanically on the rear side.

The shelf (1) comprises, for example, angle pieces as fastening elements (14) which are arranged under the carrier plate and which serve for holding the shelf, for example, in a refrigerator. However, the type of fastening is of minor importance for the subject of the invention, and the fastening illustrated is therefore to be understood as being merely by way of example.

Figure 2:
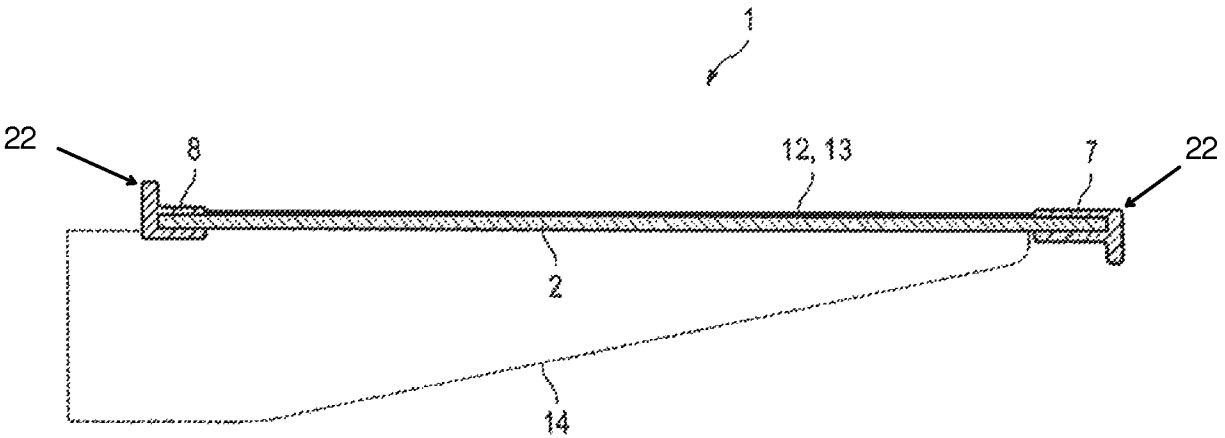
FIG. 2 shows a cross-sectional illustration of the embodiment illustrated in FIG. 1, in the sectional plane A-A.

FIG. 2 shows a cross-sectional illustration of the embodiment illustrated in FIG. 1, in the sectional plane A-A according to FIG. 1. The frame element which constitutes the front-side portion (7) of the overflow protection has essentially a U-shape and, furthermore, possesses on the underside a lip which serves as a grip element for pulling out the shelf (1). The rear margin element likewise has essentially a U-shape and possesses on the top side a lip which delimits the rear boundary of the standing surface visually and mechanically.

FIGS. 3A-3F show further preferred embodiments in perspective illustrations. The illustration of the carrier elements which are not essential to the invention has been dispensed with, so that in each case only the carrier plate (2) and the overflow protection are illustrated. Exactly as in the perspective illustration in FIG. 1, the front-side part, facing the user, of the shelf is located in each case at the bottom right and the rear-side portion therefore at the top left.

Figure 3A:
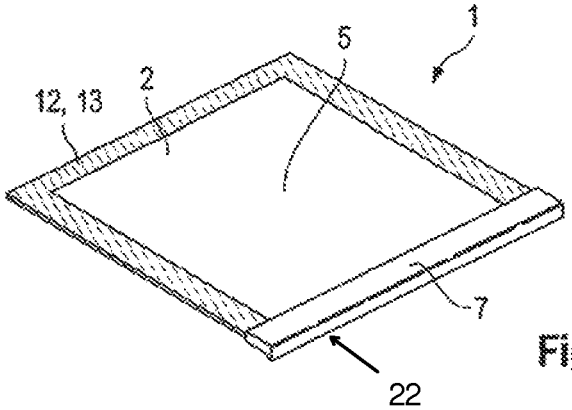
FIG. 3A shows a perspective illustration of further preferred embodiments.
Figure 3B:
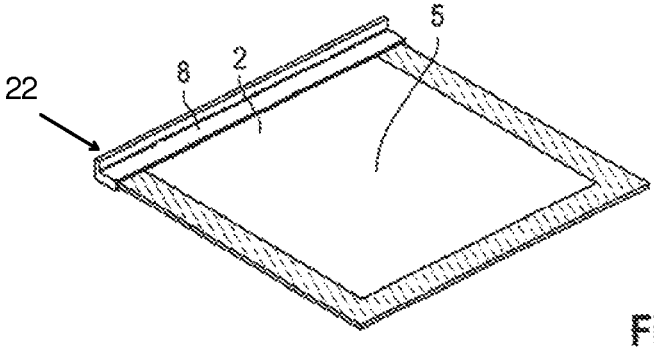
FIG. 3B shows a perspective illustration of further preferred embodiments.
Figure 3C:
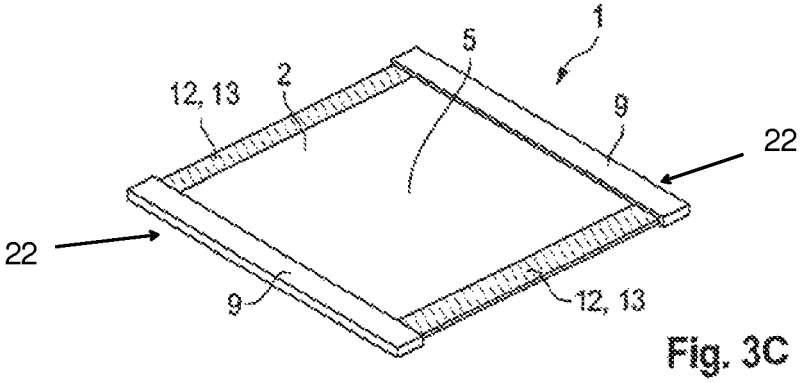
FIG. 3C shows a perspective illustration of further preferred embodiments.
Figure 3D:
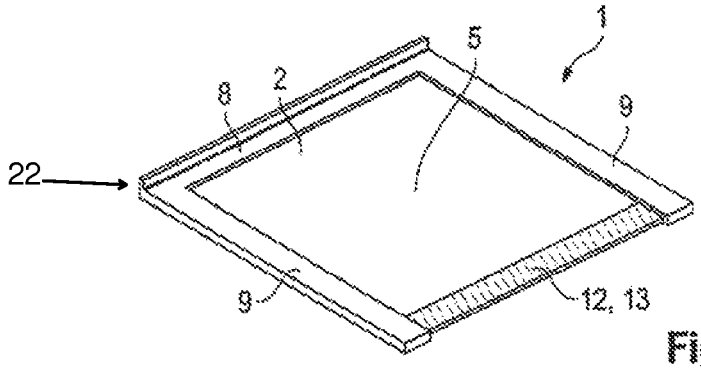
FIG. 3D.
Figure 3E:
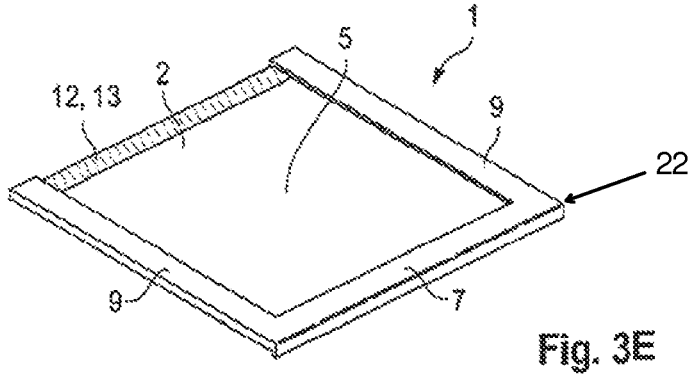
FIG. 3E shows a perspective illustration of further preferred embodiments.

In the embodiment according to FIG. 3A, a frame element (22) is formed at the front edge of the carrier plate (2) and extends over the entire length of the front edge. A band (13) of a hydrophobic layer (12) extends along both sides and also the rear side of the carrier plate (2), so that the said layer has overall a U-shape. In the embodiment according to FIG. 3B, a frame element (22) is formed at the rear edge of the carrier plate (2) and extends over the entire length of the rear edge. A band (13) of a hydrophobic layer (12) extends along both sides and also the front edge of the carrier plate (2), so that the said layer has overall a U-shape. The frame element which constitutes the rear-side part of the overflow protection is designed in the form of a profile strip which is plugged onto the rear edge. In the embodiment according to FIG. 3C, a frame element is formed at the side edges of the carrier plate and extends in each case over the entire length of the side edges. A band of a hydrophobic layer extends in each case along the front-side and the rear-side edge of the carrier plate. The frame elements which constitute the lateral parts of the overflow protection are designed in the form of profile strips which are plugged onto the side edge. The lateral frame elements serve at the same time for guidance during pushing into a refrigerator. In the embodiment according to FIG. 3D, a frame element is formed at the side edges of the carrier plate and at the rear edge and extends in each case over the entire length of the edges. A band of a hydrophobic layer extends along the front-side edge of the carrier plate. The frame elements are designed in the form of profile strips and form a coherent U-shaped profile. The lateral frame elements serve at the same time for guidance during pushing into a refrigerator. In the embodiment according to FIG. 3E, a frame element is formed at the side edges of the carrier plate and at the front edge and extends in each case over the entire length of the edges. A band of a hydrophobic layer extends along the rear-side edge of the carrier plate. The frame elements are designed in the form of profile strips and form a coherent U-shaped profile. The lateral frame elements serve at the same time for guidance during pushing into a refrigerator.

Figure 3F:
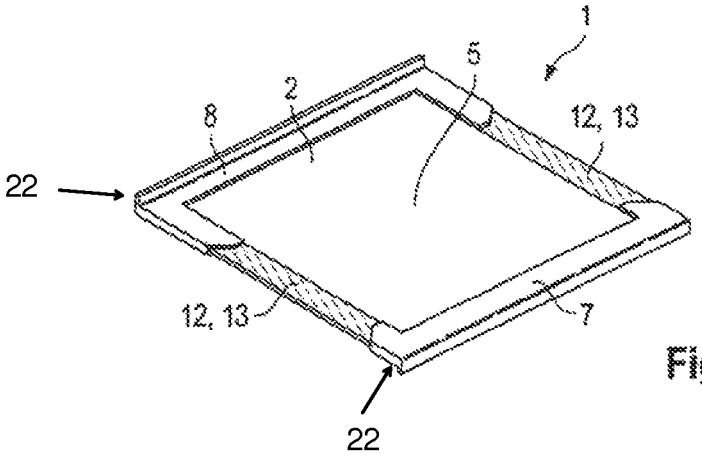
FIG. 3F shows a perspective illustration of further preferred embodiments.

In the embodiment according to FIG. 3F, a frame element is formed at the front edge and forms the front-side portion (7) of the overflow protection, and a frame element (22) is formed at the rear edge of the carrier plate and forms the rear-side portion (8) of the overflow protection, said frame element extending respectively over the entire length of the front edge and of the rear edge. The front-side and the rear-side portion of the overflow protection also extend in each case over a fraction of the two side edges, so that in each case a band (13) of a hydrophobic layer (12) is arranged only along a middle region of the two sides of the carrier plate (2). The portions arranged at the sides may advantageously serve for holding in the refrigerator, the shelf possessing a greater useful width in the middle region. Further carrier elements are not required.

FIG. 4 illustrates in cross-sectional views several embodiments of the transition region between a hydrophobic layer and a frame element by the example of the embodiment according to FIGS. 1 and 2.

Figure 4A:
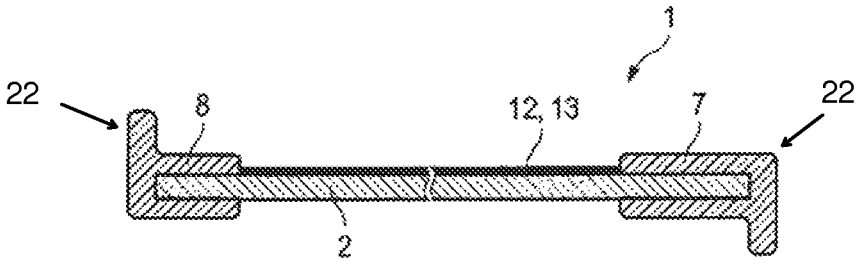
FIG. 4A shows a cross-sectional illustration of the transition region between a hydrophobic layer and a frame element in several embodiments.
Figure 4B:
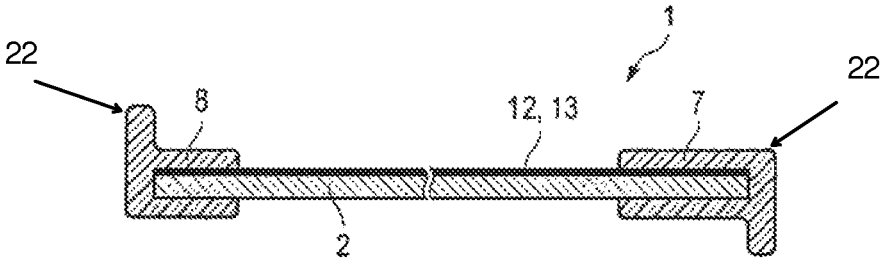
FIG. 4B shows a cross-sectional illustration of the transition region between a hydrophobic layer and a frame element in several embodiments.
Figure 4C:
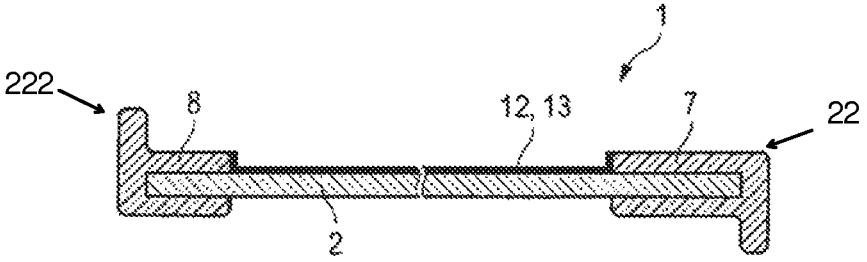
FIG. 4C shows a cross-sectional illustration of the transition region between a hydrophobic layer and a frame element in several embodiments.

In a first embodiment according to FIG. 4A, the hydrophobic layer (12) runs from the first portion exactly as far as the lower edge of the front-side frame element (7) and rear-side frame element (8). In a second embodiment according to FIG. 4B, the hydrophobic layer (12) runs from the first portion beneath the frame element and extends under the frame element as far as the end of the carrier plate. In a third embodiment according to FIG. 4C, the hydrophobic layer (12) runs from the first portion as far as the lower edge of the frame element and is then arranged on the frame element. In this embodiment, the hydrophobic layer terminates at the end of the vertical edge of the frame element.

LIST OF REFERENCE SYMBOLS

1 Shelf
2 Carrier plate
5 Middle region
7 Front-side portion
8 Rear-side portion
9 Lateral portions
12 Hydrophobic layer
13 Band of the hydrophobic layer
14 Fastening element
22 Frame element

The invention claimed is:

1. A refrigerator shelf comprising:

a carrier plate having a top side with a middle region configured to receive standing containers; and an overflow protection system arranged around the middle region, the overflow protection system having, in a first portion, only a hydrophobic layer on the carrier plate and, in a second portion which adjoins the first portion, an unreleasable frame element, the hydrophobic layer running at least as far as a lower edge of the frame element, but not underneath the frame element.

2. The refrigerator shelf according to claim 1, wherein the overflow protection system further comprises portions which, together with the first and the second portion, provide overflow protection.

3. The refrigerator shelf according to claim 1, wherein the overflow protection system completely surrounds the middle region of the carrier plate.

4. The refrigerator shelf according to claim 1, wherein the hydrophobic layer is arranged along an outer margin of the carrier plate in the form of a band.

5. The refrigerator shelf according to claim 4, wherein the band has a width of 0.5 to 5 cm.

6. The refrigerator shelf according to claim 1, wherein the hydrophobic layer has a layer thickness of 5 nm to 500 μm.

7. The refrigerator shelf according to claim 1, wherein the hydrophobic layer comprises an adhesive tape on the carrier plate.

8. The refrigerator shelf according to claim 1, wherein the frame element is arranged along an outer edge of the carrier plate and is connected, liquid-tight, to the carrier plate.

9. The refrigerator shelf according to claim 1, wherein the frame element projects vertically above the top side of the carrier plate by a height of 1.0 mm or more.

10. The refrigerator shelf according to claim 1, wherein the frame element further comprises at least one of a grip part for pulling out the shelf, a lateral guide rail, and a rear shelf boundary.

11. The refrigerator shelf according to claim 1, wherein at least a part of the frame element is removable, so that liquid captured by the overflow protection system can be discharged in a controlled way.

12. The refrigerator shelf according to claim 1, wherein the overflow protection system further comprises a front-side portion on a front side of the shelf, a rear-side portion on a rear side of the shelf, and two lateral portions on sides of the shelf.

13. The refrigerator shelf according to claim 12, wherein the two lateral portions being designed, over an entire length, as hydrophobic layers, and the front-side and/or rear-side portion comprise, over an entire length, the frame element and/or a further frame element.

14. The refrigerator shelf according to claim 1, wherein the hydrophobic layer continues on an edge of the frame element that rises above the lower edge of the frame element.

15. A refrigerator shelf comprising:

a carrier plate having a top side configured to receive standing containers; and an overflow protection system arranged along all edges of the carrier plate and projecting above the top side so that liquid is captured on the top side, the overflow protection system comprising a band of hydrophobic layer on the top side of the carrier plate running along at least one of the edges and an unreleasable frame element connected, liquid-tight, to the carrier plate and running along a remainder of the edges, wherein the remainder of the edges do not include the band of hydrophobic layer running along an entire length, and wherein the frame element is a separate component from the carrier plate.

16. The refrigerator shelf according to claim 15, wherein at least a part of the frame element is removable.

17. The refrigerator shelf according to claim 15, wherein the band runs along more than one edge.

18. The refrigerator shelf according to claim 15, further comprising a transition region between the band and the frame element, wherein the transition region does not extend underneath a lower edge of the frame element.

19. The refrigerator shelf according to claim 18, wherein the transition region extends onto a wall of the frame element, wherein the wall rises above the lower edge of the frame element.

20. The refrigerator shelf according to claim 15, further comprising a transition region between the band and the frame element, wherein the transition region extends under the frame element.

21. A refrigerator shelf comprising:

a carrier plate having a top side with a middle region configured to receive standing containers and an outer region that completely surrounds the middle region, the outer region consisting of a front portion, a rear portion, and lateral side portions; and an overflow protection system arranged on the outer region, the overflow protection system comprising a hydrophobic layer and an unreleasable frame element, the hydrophobic layer being on a first portion of the outer region and exerting overflow protection to the first portion due only to hydrophobicity of the hydrophobic layer, and the frame element connected, liquid-tight on a second portion of the outer region and exerting overflow protection to the second portion as a physical barrier because of a vertical extent projecting above the top side; and a transition region between the hydrophobic layer and the frame element, at the transition region the hydrophobic layer either extends to the frame element but not underneath the frame element, or extends under the frame element.

22. The refrigerator shelf according to claim 21, wherein the first portion of the outer region is the lateral side portions, and wherein the second portion of the outer region is the front and rear portions.

23. The refrigerator shelf according to claim 21, wherein the first portion of the outer region is the lateral side portions and the rear portion, and wherein the second portion of the outer region is the front portion.

24. The refrigerator shelf according to claim 21, wherein the first portion of the outer region is the lateral side portions and the front portion, and wherein the second portion of the outer region is the rear portion.

25. The refrigerator shelf according to claim 21, wherein the first portion of the outer region is the front and rear portions, and wherein the second portion of the outer region is the lateral side portions.

26. The refrigerator shelf according to claim 21, wherein the first portion of the outer region is the front portion, and wherein the second portion of the outer region is the lateral side portions and the rear portion.

27. The refrigerator shelf according to claim 21, wherein the first portion of the outer region is only central sections of the lateral side portions, and wherein the second portion of the outer region is the front and rear portions and remaining sections of the lateral side portions.

28. The refrigerator shelf according to claim 21, wherein, in the transition region, the hydrophobic layer terminates at a lower edge of the frame element.

29. The refrigerator shelf according to claim 21, wherein, in the transition region, the hydrophobic layer runs passed a lower edge of the frame element so as to extend under the frame element.

30. The refrigerator shelf according to claim 21, wherein, in the transition region, the hydrophobic layer runs to a lower edge of the frame element and runs on a vertical edge of the frame element.

31. The refrigerator shelf according to claim 30, wherein the hydrophobic layer terminates at an end of the vertical edge of the frame element.

32. The refrigerator shelf according to claim 21, wherein at least a part of the frame element is removable, so that liquid captured by the overflow protection system can be discharged in a controlled way.

33. The refrigerator shelf according to claim 21, wherein the frame element exerts overflow protection to the second portion only as the physical barrier.

34. The refrigerator shelf according to claim 15, wherein the hydrophobic layer runs at least as far as the lower edge of the frame element, but not underneath the frame element.

35. The refrigerator shelf according to claim 21, wherein the hydrophobic layer runs at least as far as the lower edge of the frame element, but not underneath the frame element.

36. The refrigerator shelf according to claim 1, wherein the carrier plate has a front portion and the frame element is arranged along the front portion.

37. The refrigerator shelf according to claim 15, wherein the carrier plate has a front portion and the frame element is arranged along the front portion.

38. The refrigerator shelf according to claim 21, wherein the frame element is arranged along the front portion.

39. The refrigerator shelf according to claim 1, wherein the refrigerator shelf does not have a fastening element to hold the refrigerator shelf in a refrigerator.

40. The refrigerator shelf according to claim 15, wherein the refrigerator shelf does not have a fastening element to hold the refrigerator shelf in a refrigerator.

41. The refrigerator shelf according to claim 21, wherein the refrigerator shelf does not have a fastening element to hold the refrigerator shelf in a refrigerator.

42. The refrigerator shelf according to claim 1, wherein the frame element is adhesively bonded to the carrier plate.

43. The refrigerator shelf according to claim 15, wherein the frame element is adhesively bonded to the carrier plate.

44. The refrigerator shelf according to claim 21, wherein the frame element is adhesively bonded to the carrier plate.

* * * * *